US011487227B2

(12) United States Patent
Suzuki et al.

(10) Patent No.: US 11,487,227 B2
(45) Date of Patent: Nov. 1, 2022

(54) INTERMEDIATE TRANSFER MEMBER AND IMAGE FORMING APPARATUS

(71) Applicant: CANON KABUSHIKI KAISHA, Tokyo (JP)

(72) Inventors: Midai Suzuki, Tokyo (JP); Akeshi Asaka, Chiba (JP); Koji Sato, Ibaraki (JP); Noriaki Kobayashi, Ibaraki (JP); Megumi Uchino, Tokyo (JP); Akira Okano, Kanagawa (JP); Toshiyuki Yoshida, Kanagawa (JP); Naoko Kasai, Kanagawa (JP); Atsushi Hori, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/544,754

(22) Filed: Dec. 7, 2021

(65) Prior Publication Data

US 2022/0187741 A1 Jun. 16, 2022

(30) Foreign Application Priority Data

Dec. 14, 2020 (JP) ..... JP2020-207098

(51) Int. Cl.
*G03G 15/16* (2006.01)
*G03G 15/01* (2006.01)

(52) U.S. Cl.
CPC ..... *G03G 15/162* (2013.01); *G03G 15/0131* (2013.01); *G03G 15/1605* (2013.01); *G03G 15/1685* (2013.01); *G03G 2215/1623* (2013.01)

(58) Field of Classification Search
CPC ..... G03G 15/0131; G03G 15/1605; G03G 15/162; G03G 15/1685; G03G 2215/1623
See application file for complete search history.

(56) References Cited

U.S. PATENT DOCUMENTS

2009/0116881 A1* 5/2009 Shirose ..... G03G 15/162 399/308
2012/0243916 A1* 9/2012 Oomori ..... G03G 15/162 399/302
2020/0356029 A1* 11/2020 Takei ..... G03G 15/162

FOREIGN PATENT DOCUMENTS

JP 2005112942 A 4/2005

* cited by examiner

*Primary Examiner* — Joseph S Wong
(74) *Attorney, Agent, or Firm* — Canon U.S.A., Inc., IP Division

(57) ABSTRACT

The crystallinity of a thermoplastic resin is 8% or more and 25% or less, the average primary particle size of carbon black is 10 nm or more and 30 nm or less, the content of the carbon black is 15.0 parts by mass or more and 30.0 parts by mass or less with respect to 100 parts by mass of an intermediate transfer belt, and (Li+Lo+Lc)/3≤100 nm, where Li, Lo, and Lc are values of an L-function indicating a dispersibility of the carbon black with respect to the thermoplastic resin in an inner peripheral surface region of the intermediate transfer belt, in an outer peripheral surface region, and in a central region that is a central portion of the intermediate transfer belt in a thickness direction of the intermediate transfer belt, respectively.

6 Claims, 4 Drawing Sheets

INTERMEDIATE TRANSFER MEMBER AND IMAGE FORMING APPARATUS

BACKGROUND OF THE INVENTION

Field of the Invention

The present disclosure relates to an intermediate transfer member configured to bear a toner image and an image forming apparatus including the intermediate transfer member.

Description of the Related Art

An intermediate transfer method has been used widely in, for example, electrophotographic image forming apparatuses. In the intermediate transfer method, a toner image is primarily transferred onto an intermediate transfer member at a primary transfer portion, and thereafter the toner image is secondarily transferred onto a recording material such as a sheet at a secondary transfer portion, whereby an image is output. The intermediate transfer member is also referred to as an intermediate transfer belt.

An intermediate transfer member that is adjusted to a desired electrical resistance by adding an electroconductive filler to a resin material has been discussed (Japanese Patent Application Laid-Open No. 2005-112942).

An intermediate transfer member used in the intermediate transfer method is normally suspended by two or more rollers and is driven and rotated in a tense state for a long time. Thus, an intermediate transfer member is required to have high durability and excellent mechanical properties. Especially, an intermediate transfer member that is excellent in tensile elastic modulus and flexural durability is desirable. For example, in a case where an intermediate transfer member has an excessively low tensile elastic modulus, the intermediate transfer belt may be distorted depending on usage conditions. This not only decreases durability of the intermediate transfer belt but also causes an image defect due to a distortion or misalignment of a transferred toner image on a surface of the intermediate transfer member. Poor flexural durability leads to the breaking or splitting of the intermediate transfer belt.

An intermediate transfer member made of a resin composition including a thermoplastic resin as a main component can be heated to increase the crystallinity of the resin composition so that the resulting intermediate transfer member has desired tensile strength, flexural durability, and surface hardness. However, in a case where a sheet or a resin film that is controlled to have a resistance to a semiconducting region using an electroconductive filler such as an electroconductive carbon black is heated to a melting point or higher to modify the surface, a slight difference in temperature or pressure causes a change in resistance values, resulting in uneven resistance values. This is considered to occur due to decreased dispersibility of carbon black contained in the resin component as a result that agglomeration of the carbon black is promoted by the heating.

Especially, a resin film made of a thermoplastic resin exhibits a significant change in resistance at a temperature immediately below the melting point. This is considered to occur due to promotion of agglomeration (decreased dispersibility) of the carbon black as a result that crystallization of the thermoplastic resin facilitates deposition of the carbon black at crystallized portions of the thermoplastic resin.

A decrease in dispersibility of the electroconductive filler of the intermediate transfer member being a resin film may result in an image defect, especially in a low-humidity environment. At the primary transfer portion, in a case where a space is formed between an inner peripheral surface of the intermediate transfer member and a primary transfer roller, an electric discharge occurs between an agglomerate portion of the electroconductive filler of the intermediate transfer member and the primary transfer roller, and the resistance of the intermediate transfer member decreases locally. Toner is not transferred to the portion with the decreased resistance, and an image with the portion missing to leave blank parts (image with missing parts) is generated. This behavior is significant especially in a case where a metal roller is used as the primary transfer roller. Further, at the secondary transfer portion, in a case where a space is formed between an outer peripheral surface of the intermediate transfer member and the sheet, an electric discharge occurs between the agglomerate portion of the electroconductive filler of the intermediate transfer member and the sheet, and the charging polarity of the toner on the intermediate transfer member is reversed by the electric discharge. Thus, the toner is not transferred onto the sheet, and an image with missing parts is formed.

For the foregoing reasons, it has been difficult to realize an intermediate transfer belt made of a thermoplastic resin containing carbon black with secured mechanical strength of the intermediate transfer belt and improved dispersibility of the carbon black.

SUMMARY OF THE INVENTION

The present disclosure is directed to an intermediate transfer belt made of a thermoplastic resin containing carbon black with secured mechanical strength of the intermediate transfer belt and improved dispersibility of the carbon black.

The above-described issues are solved by a solution described below.

According to an aspect of the present disclosure, an intermediate transfer belt which has an endless belt shape and to which a toner image is to be transferred includes a base layer containing a thermoplastic resin with carbon black dispersed in the thermoplastic resin, wherein an average primary particle size of the carbon black is 10 nm or more and 30 nm or less, wherein a content of the carbon black is 15.0% by mass or more and 30.0% by mass or less with respect to the belt member, wherein the thermoplastic resin has a crystallinity of 8% or more and 25% or less, and wherein $(Li+Lo+Lc)/3 \leq 100$ nm, where Li is a value of an L-function indicating a dispersibility of the carbon black with respect to the thermoplastic resin in an outer peripheral surface region having a range of 10 μm from an outer peripheral surface of the base layer in a thickness direction of the belt member, Lo is a value of the L-function indicating a dispersibility of the carbon black with respect to the thermoplastic resin in an inner peripheral surface region having a range of 10 μm from an inner peripheral surface of the belt member in the thickness direction, and Lc is a value of the L-function indicating a dispersibility of the carbon black with respect to the thermoplastic resin in a central region having a range of 5 μm in the thickness direction and another range of 5 μm in the thickness direction from a central portion of the belt member in the thickness direction.

Further features of the present disclosure will become apparent from the following description of exemplary embodiments with reference to the attached drawings.

DESCRIPTION OF THE EMBODIMENTS

An intermediate transfer member and a method of manufacturing an intermediate transfer member according to an exemplary embodiment of the present disclosure will be described in further detail below with reference to the drawings.

1. Image Forming Apparatus

Figure 1:
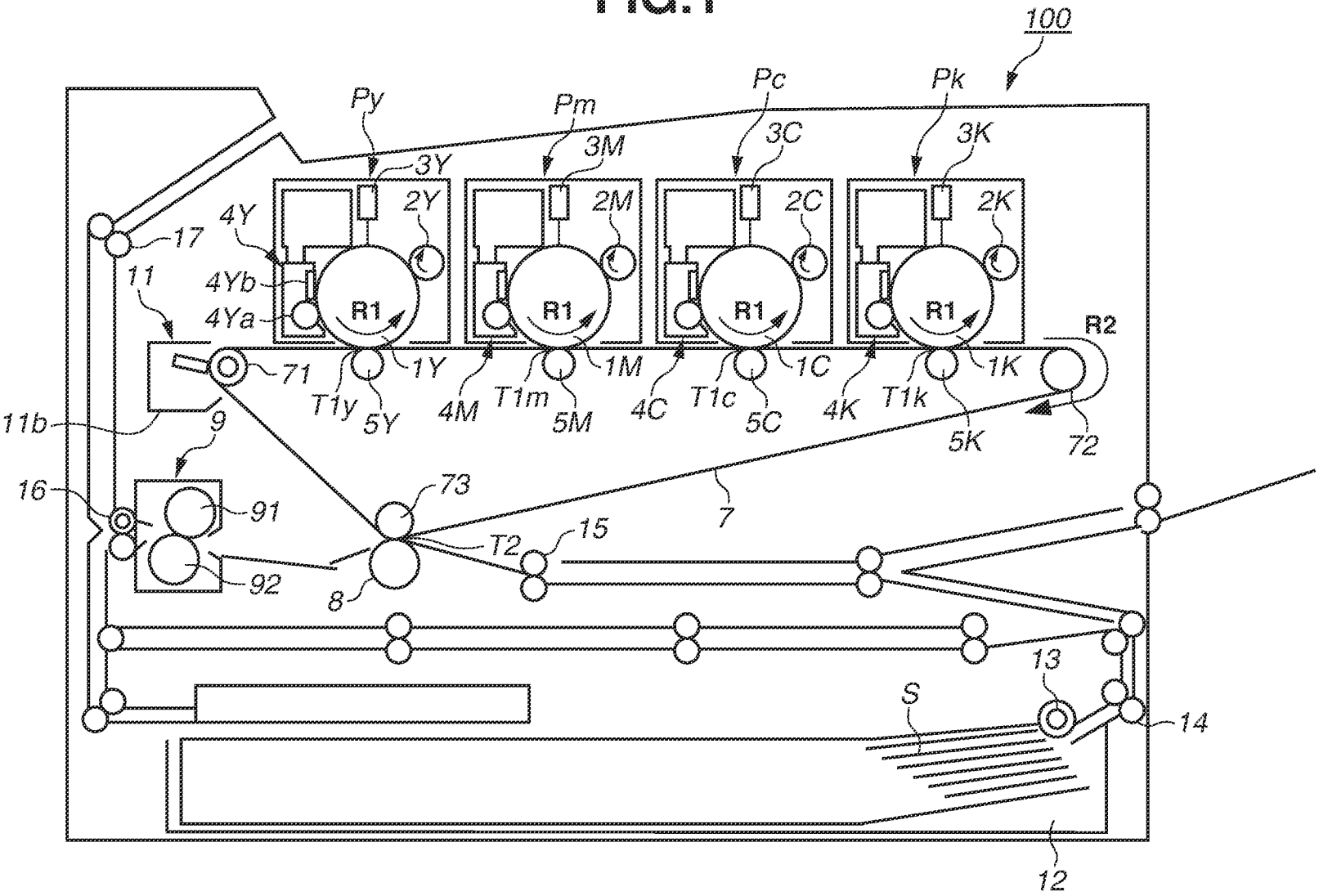
FIG. 1 is a schematic diagram illustrating a cross-section of an image forming apparatus using an intermediate transfer member according to an exemplary embodiment of the present disclosure.

First, an image forming apparatus using an intermediate transfer member (intermediate transfer belt) according to an exemplary embodiment of the present disclosure will be described below. FIG. 1 is a schematic cross-sectional view illustrating an image forming apparatus 100 according to the present exemplary embodiment. The image forming apparatus 100 according to the present exemplary embodiment is a tandem color laser printer that employs an intermediate transfer method and forms full-color images using an electrophotographic method.

The image forming apparatus 100 includes a plurality of image forming units, first, second, third, and fourth image forming units PY, PM, PC, and PK. The first, second, third, and fourth image forming units PY, PM, PC, and PK are arranged in this order along a movement direction of a flat portion (image transfer surface) of an intermediate transfer belt 7. Elements of the first, second, third, and fourth image forming units PY, PM, PC, and PK that have the same or corresponding function or configuration are sometimes described collectively without the letters Y (or y), M (or m), C (or c), and K (or k), which indicate colors for which the elements are provided, at the end. According to the present exemplary embodiment, the image forming unit P includes a photosensitive drum 1, a charging roller 2, an exposure device 3, a development device 4, and a primary transfer roller 5 described below.

The image forming unit P includes the photosensitive drum 1. The photosensitive drum 1 is a drum-shaped (cylindrical) photosensitive member (electrophotographic photosensitive member) as an image bearing member. The photosensitive drum 1 includes an electric charge generation layer, an electric charge transport layer, and a surface protection layer that are layered in this order on an aluminum cylinder as a base member. The photosensitive drum 1 is driven and rotated in a direction (anti-clockwise) specified by an arrow R1 in FIG. 1. The rotated surface of the photosensitive drum 1 is uniformly charged to a predetermined potential of a predetermined polarity (negative polarity in the present exemplary embodiment) by the charging roller 2. The charging roller 2 is a roller-shaped charging member as a charging unit. During the charging, a predetermined charging bias (charging voltage) including a direct-current component of negative polarity is applied to the charging roller 2. The charged surface of the photosensitive drum 1 is scanned and exposed by the exposure device (laser scanner) 3 as an exposure unit based on image information, and an electrostatic image (electrostatic latent image) is formed on the photosensitive drum 1.

The development device 4 as a development unit supplies toners as a developer and develops (visualizes) the electrostatic image formed on the photosensitive drum 1, and a toner image (developer image) is formed on the photosensitive drum 1. During the development, a predetermined development bias (development voltage) including a direct-current component of negative polarity is applied to a development roller 4*a* as a developer bearing member of the development device 4. According to the present exemplary embodiment, the exposure is performed after the uniformly-charging processing so that the toners charged to a polarity (negative polarity in the present exemplary embodiment) that is the same as the charging polarity of the photosensitive drum 1 are attached to the exposed portion (image portion) on the photosensitive drum 1 with the decreased absolute value of the potential.

The intermediate transfer belt 7 including an endless belt is arranged as an intermediate transfer member to face the four photosensitive drums 1. The intermediate transfer belt 7 is stretched by a driving roller 71, a tension roller 72, and a secondary transfer counter roller 73 as a plurality of tension rollers with a predetermined tensile force. As the driving roller 71 is driven and rotated, the intermediate transfer belt 7 is brought into contact with the photosensitive drum 1 and rotated (moved around) in a direction (clockwise) specified by an arrow R2 in FIG. 1. The primary transfer roller 5 is a roller-shaped primary transfer member as a primary transfer unit and is arranged on the inner peripheral surface side of intermediate transfer belt 7 correspondingly to each photosensitive drum 1. The primary transfer roller 5 is pressed toward the photosensitive drum 1 through the intermediate transfer belt 7 and forms a primary transfer portion (primary transfer nip) T1 where the photosensitive drum 1 and the intermediate transfer belt 7 are in contact with each other. The toner image formed on the photosensitive drum 1 as described above is primarily transferred onto the rotating intermediate transfer belt 7 by the action of the primary transfer roller 5 at the primary transfer portion T1. During the primary transfer, a primary transfer bias (primary transfer voltage) is applied to the primary transfer roller 5. The primary transfer bias is a direct-current voltage having a polarity (positive polarity in the present exemplary embodiment) opposite to the normal charging polarity (charging polarity during the development) of the toner. The primary transfer roller 5 has a metallic rotation shaft and an elastic layer formed on an outer peripheral surface of the rotation shaft. While the primary transfer roller 5 that is adjusted to have a desired resistance value is often used, the primary transfer roller 5 can be a metal roller containing sulfur and sulfur composite free-cutting steel (SUM) or stainless steel (SUS) as a material and having a straight shape in a thrust direction.

A secondary transfer roller 8 is a roller-shaped secondary transfer member as a secondary transfer unit and is arranged on the outer peripheral surface side of the intermediate transfer belt 7 at a position facing the secondary transfer counter roller 73. The secondary transfer roller 8 is pressed toward the secondary transfer counter roller 73 through the intermediate transfer belt 7 and forms a secondary transfer portion (secondary transfer nip) T2 where the intermediate transfer belt 7 and the secondary transfer roller 8 are in contact with each other. At the secondary transfer portion T2, the toner image formed on the intermediate transfer belt 7 as described above is secondarily transferred by the action of the secondary transfer roller 8 onto a recording material (sheet, or transfer material) S such as paper (sheet) held and conveyed by the intermediate transfer belt 7 and the secondary transfer roller 8. During the secondary transfer, a secondary transfer bias (secondary transfer voltage) is applied to the secondary transfer roller 8. The secondary transfer bias is a direct-current voltage of a polarity opposite to the normal charging polarity of the toner. During the secondary transfer, normally a transfer voltage of several kV is applied to ensure sufficient transfer efficiency. The recording material S is fed from a cassette 12 storing the recording materials S to a conveyance path by a pickup roller 13. The recording material S fed to the conveyance path is conveyed to the secondary transfer portion T2 by a pair of conveyance rollers 14 and a pair of registration rollers 15 at a timing in synchronization with the toner image on the intermediate transfer belt 7.

The recording material S with the transferred toner image thereon is conveyed to a fixing device 9 as a fixing unit. The fixing device 9 heats and presses the recording material S bearing the unfixed toner image to fix (melt, firmly fix) the toner image to the recording material S. The recording material S with the fixed toner image is ejected (output) to the outside of a main body of the image forming apparatus 100 by a pair of conveyance rollers 16 and a pair of ejection rollers 17.

The toner (primary transfer residual toner) that is not transferred to the intermediate transfer belt 7 during the primary transfer and remains on the surface of the photosensitive drum 1 is collected by the development device 4, which is also a photosensitive member cleaning unit, simultaneously with the development. Further, the toner (secondary transfer residual toner) that is not transferred to the recording material S during the secondary transfer and remains on the surface of the intermediate transfer belt 7 is removed from the surface of the intermediate transfer belt 7 and collected by a belt cleaning device 11, which is an intermediate transfer member cleaning unit. The belt cleaning device 11 is disposed downstream of the secondary transfer portion T2 and upstream of the primary transfer portion T1*y* situated at the uppermost stream in the rotation direction of the intermediate transfer belt 7 (at a position facing the driving roller 71 in the present exemplary embodiment). The belt cleaning device 11 scrapes the secondary transfer residual toner off the surface of the rotating intermediate transfer belt 7 using a cleaning blade and stores the scraped toner in a collecting container 11*b*. The cleaning blade is a cleaning member situated to be in contact with the surface of the intermediate transfer belt 7.

As described above, the process of electrically transferring a toner image from the photosensitive drum 1 to the intermediate transfer belt 7 and from the intermediate transfer belt 7 to the recording material S is repeated during the image forming operation. Further, as image forming is repeatedly performed on a large number of recording materials S, the process of electric transfer is further repeated.

2. Intermediate Transfer Member

Figure 2B:
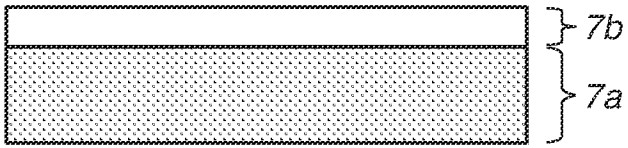
FIGS. 2A and 2B are schematic diagrams illustrating cross-sections of intermediate transfer members according to an exemplary embodiment of the present disclosure.
Figure 2A:
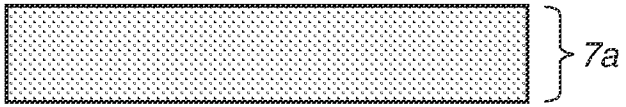

The intermediate transfer belt 7 as an intermediate transfer member includes at least a base layer (base material) and can be a layered member including a plurality of layers further including a surface layer (front layer). FIGS. 2A and 2B are schematic cross-sectional views illustrating an example of a layer structure of the intermediate transfer belt 7. The intermediate transfer belt 7 can consist of a single layer 7*a* (the term "base layer" is also used herein even in the case of a single layer) as illustrated in FIG. 2A. Further, the intermediate transfer belt 7 can consist of at least two layers that are the base layer 7*a* and a surface layer 7*b* on the base layer 7*a* as illustrated in FIG. 2B. For example, another layer such as an intermediate layer can be provided between the base layer 7*a* and the surface layer 7*b*. As described in detail below, the base layer 7*a* is a semi-conducting film in which a resin contains an electroconductive filler.

2-1. Structure and Properties of Intermediate Transfer Member

Resin Material

A thermoplastic resin such as polyphenylenesulfide (PPS), polyetherimide (PEI), or polyetheretherketone (PEEK) can be used as a resin material of a base layer of an intermediate transfer belt consisting of a single layer or as a resin material of a base layer of an intermediate transfer belt consisting of at least two or more layers. Especially PEEK is desirable because an intermediate transfer belt desirably has properties that the intermediate transfer belt is not elongated by long-term application of tensile load and is resistant to surface abrasion caused by the rubbing by the cleaning blade. Further, two or more of the resins can be selected and used in mixture as needed.

Electroconductive Filler

The resin material contains at least one type of an electroconductive filler such as carbon black or metal particles in order to provide electroconductivity to the base layer. Carbon black is desirable in terms of mechanical properties. Different terms are used to refer to carbon black depending on how the carbon black is prepared and what materials are used. Specific examples are ketjen black, furnace black, acetylene black, thermal black, and gas black.

Various types of publicly-known carbon blacks can be used. Specific examples are ketjen black, furnace black, acetylene black, thermal black, and gas black. Among the carbon blacks, acetylene black and furnace black are desirable because of the low content of impurities, the low frequency of foreign matter defects in molding the carbon black and the thermoplastic resin into a film shape, and the ease of obtaining desired electroconductivity. Specific examples of acetylene black are "DENKA BLACK" series (manufactured by Denka Company Limited), "Mitsubishi conductive filler" series (manufactured by Mitsubishi Chemical Corporation), "VULCUN" series (manufactured by Cabot Corporation), "Printex" series (Degussa, Inc), and "SRF" (manufactured by Asahi Carbon Co., Ltd.). Specific examples of furnace black are "TOKABLACK" series (manufactured by TOKAI CARBON CO., LTD.), "Asahi carbon black" series (manufactured by Asahi Carbon Co., Ltd.), and "NITERON" series (manufactured by Shinnikka Carbon Co., Ltd.).

Primary Particle Size of Carbon Black

An electroconductive filler with an average primary particle size of 10 nm or more and 30 nm or less is desirably used as an electroconductive filler to be added. Use of an electroconductive filler with an average primary particle size of less than 10 nm often results in re-agglomeration of the filler and a decrease in heat resistance, so that it is difficult to use it in an intermediate transfer member. On the other hand, use of an electroconductive filler with an average primary particle size of greater than 30 nm often results in a decrease in dispersibility in a case where an aggregate is formed, and a decrease in resistance of the intermediate transfer member by the electric discharge often occurs. Thus, an average primary particle size within the above-specified range is used to obtain a desirable resistance maintaining property without defects.

Electroconductive Filler Content

The electroconductive filler content is selected based on whether sufficient electroconductivity for a belt member is provided, mechanical strength such as flex resistance and elastic modulus of the belt member, and thermal conductivity. An excessively high electroconductive filler content causes a decrease in mechanical strength, so that a desirable electroconductive filler content is 30.0 wt % or less.

On the other hand, an excessively low content may lead to a consequence that the electric conductivity of the belt member becomes excessively low or a consequence that it becomes difficult to maintain a suitable dispersion state of the electroconductive filler in the intermediate transfer belt, so that a desirable electroconductive filler content is 15.0 wt % or higher, desirably 20.0 wt % or higher. In other words, 15.0 parts by mass or more and 30.0 parts by mass or less with respect to 100 parts by mass of the intermediate transfer belt is desirable.

Specifically, in a case where the intermediate transfer member consists of only a base layer that is a single layer containing a thermoplastic resin and carbon black dispersed in the thermoplastic resin, the carbon black content is desirably 15.0% by mass to 30.0% by mass with respect to the base layer.

Crystallinity

A thermoplastic resin is composed of a tangle of string-shaped polymers and is roughly divided into a crystalline resin and an amorphous resin according to behavior in curing. Some thermoplastic resins are tangled while molecular motion in a dissolution state, but as the temperature is decreased from the temperature in the dissolution state, the molecular motion is gradually stopped with the decreasing temperature, and the thermoplastic resins are partially aligned at a crystallization temperature (Tc) temperature. This type of a thermoplastic resin is referred to as a crystalline resin, whereas a thermoplastic resin that is solidified while being randomly tangled is referred to as an amorphous resin.

Crystallinity is the calculated proportion of a crystal region (C) in a resin solid that includes the crystal region (C) and an amorphous region (G). Crystallinity is used as an index for strength, stiffness, transparency, and mold shrinkage of a resin material. According to the present exemplary embodiment, for example, a crystallinity less than 8% as measured by wide angle X-ray diffraction (XRD) is determined as an amorphous state. According to the present exemplary embodiment, the crystallinity of the thermoplastic resin is desirably 8% or higher and 25% or less. In a case where the crystallinity of the thermoplastic resin is less than 8%, the mechanical strength of the intermediate transfer belt decreases. On the other hand, in a case where the crystallinity of the thermoplastic resin is higher than 25%, carbon black agglomeration occurs.

Dispersibility

Dispersibility is evaluated using an L-function described below. At the primary transfer portion, the value of the L-function of the inner peripheral surface of the intermediate transfer member is desirably 150 nm or less in a case where a metal roller is used as the primary transfer member. In a case where the value of the L-function is greater than 150 nm, a decrease in resistance of the intermediate transfer member by the electric discharge at the primary transfer portion often occurs. Specifically, as described below, $Li \leq 150$ nm is desirable, where Li is the value of the L-function indicating the dispersibility of the carbon black with respect to the thermoplastic resin in the inner peripheral surface region of the intermediate transfer belt.

A reason why a decrease in resistance of the intermediate transfer member by the electric discharge at the primary transfer portion often occurs in a case where a metal roller is used as the primary transfer member is as described below. Specifically, in a case where the primary transfer member is a metal roller and is arranged so that the intermediate transfer member is nipped between the primary transfer member and the photosensitive drum, the photosensitive drum may be damaged. Thus, the primary transfer member and the photosensitive drum are arranged with an offset from each other in the movement direction of the intermediate transfer member so that the intermediate transfer member is not nipped between the photosensitive drum and the metal roller. Thus, in a case where the primary transfer member is a metal roller and the intermediate transfer member is waved, a space may be formed at the primary transfer portion, and an electric discharge often occurs. On the other hand, in a case where the primary transfer member is a sponge roller, the photosensitive drum and the sponge roller nip the intermediate transfer member and form the primary transfer portion. Thus, in a case where the intermediate transfer member is waved, a space is not formed at the primary transfer portion, and an electric discharge is less likely to occur.

At the secondary transfer portion, the average of the L-function values of a central region and inner and outer peripheral surfaces of the intermediate transfer member is desirably 100 nm or less. In a case where the value of the L-function is greater than 100 nm, a decrease in resistance of the intermediate transfer member by the electric discharge often occurs at the secondary transfer portion.

Specifically, as described below, $(Li+Lo+Lc)/3 \leq 100$ nm is desirable, where Li, Lo, and Lc are the values of the L-function indicating the dispersibility of the carbon black with respect to the thermoplastic resin at the inner peripheral surface region, the outer peripheral surface region, and the central region of the intermediate transfer belt, respectively. The central region of the intermediate transfer belt is a central portion in a thickness direction of the intermediate transfer belt.

Number of Conductive Points

In a case where a metal roller is used as the primary transfer member, the number of conductive points of the inner peripheral surface of the intermediate transfer member is desirably 230 points/$\mu m^2$ or more. This prevents a decrease in resistance of the intermediate transfer member by the electric discharge even in a case where a space is formed between the intermediate transfer member and the metal roller. In a case where the number of conductive points is less than 230 points/$\mu m^2$, a local electric discharge occurs at a space between the primary transfer roller and the intermediate transfer member, and this may generate a deep electric discharge mark in the inner peripheral surface of the intermediate transfer member. The electric discharge mark is caused by resin degradation (carbonization), the electroconductivity at the electric discharge mark is higher than its neighborhood, i.e., the electrical resistance is low. Thus, the surface resistivity of the inner peripheral surface of the intermediate transfer member decreases. The greater the number of conductive points is, the less the electric discharge is concentrated, and the number of conductive points is selected based on a desirable resistance range of the intermediate transfer member.

2-2. Method of Manufacturing Intermediate Transfer Member

The base layer of the intermediate transfer member consisting of a single layer or the base layer of the intermediate transfer member consisting of at least two or more layers according to the present exemplary embodiment is formed by the following process.

(1) A molding process in which a resin composition containing a resin material and an electroconductive filler is melted at a temperature higher than or equal to a melting temperature of the resin material and the resulting resin composition is molded into a tubular tube shape.

(2) A heating and pressing process in which the tubular tube prepared by the molding process is sandwiched between a hollow cylindrical inner mold and a hollow cylindrical outer mold with controlled inner roughness, heated to a predetermined temperature between a glass-transition temperature and a crystallization start temperature of the resin composition at a temperature increase rate of 10° C./min or higher, pressed at 10 kgf/cm$^2$ or higher under the temperature range, cooled to a temperature lower than or equal to the glass-transition point, and then released from the molds. The processes (1) and (2) will be described below.

Molding Process

In the molding process, a resin composition containing a resin material and an electroconductive filler is molded into a belt shape in the shape of a cylindrical tube (tubular tube) using an extrusion molding method. A resin composition for use in semi-conducting tubular tube molding according to the present exemplary embodiment is prepared using a predetermined method and facilities. For example, raw material components are premixed by a mixer such as a Henschel mixer or a tumbler, and a filler such as glass fiber is added as needed to the premixed raw material components and mixed. Thereafter, the resulting mixture is kneaded and extruded using a single- or twin-screw extruder into a pellet for molding. A method can be employed in which a masterbatch is prepared using part of necessary components and then the masterbatch is mixed with the remaining components. Further, part of raw materials for use can be pulverized to the same particle size, mixed together, melted, and extruded in order to increase the dispersibility of each raw material component.

In the extrusion molding method, either a single-screw extruder with a single screw in a barrel or a cylinder and a multi-screw extruder with a combination of two or more screws can be used. A resin composition containing a resin material and 15 parts by weight to 30 parts by weight of an electroconductive filler is fed from a feeding hole of a feeding unit, and while moved forward toward a die by screw rotation, the resin component receives thermal energy from the barrel or the cylinder and mechanical energy from the screw and is melted completely. Then, while the temperature of the resin composition is controlled in the range of the melting point (Tm) to Tm+80° C., a predetermined amount of the resin composition is fed to a leading end portion of the extruder and melted and extruded in the form of a film from a circular die. Next, the inner peripheral surface of the tube in the melt state is brought into contact with a cooling mandrel controlled to a temperature lower than or equal to the glass-transition temperature (Tg), and while the inner surface is rapidly cooled and solidified, the outer surface is slowly cooled using an external heating device controlled to a temperature not lower than Tm−60° C. and not higher than Tm to control the crystallinity of the outer and inner surfaces. The temperature of the resin composition in the extruder is Tm+20° C. to 80° C., desirably Tm+30° C. to 70° C., more desirably Tm+40° C. to 60° C. The resin temperature is exemplified by the die temperature. The resin composition in the melt state that is withdrawn from a die lip is extracted and molded into the shape of a film (including a tube-shaped film), and in this process, the extraction rate is controlled to adjust the film thickness to a desired film thickness.

The temperature of a cooling roll or cooling mandrel that is brought into contact with a film (including a tube-shaped film) in the melt state to cool the film is in the range of Tg−60° C. to Tg. In a case where the cooling temperature is excessively high, resin crystallization is developed, and the semi-electroconductive film often becomes fragile. On the other hand, in a case where the cooling temperature is excessively low, the cooling becomes uneven, and it becomes difficult to obtain a semi-electroconductive film with excellent planarity and thickness stability.

Figure 3:
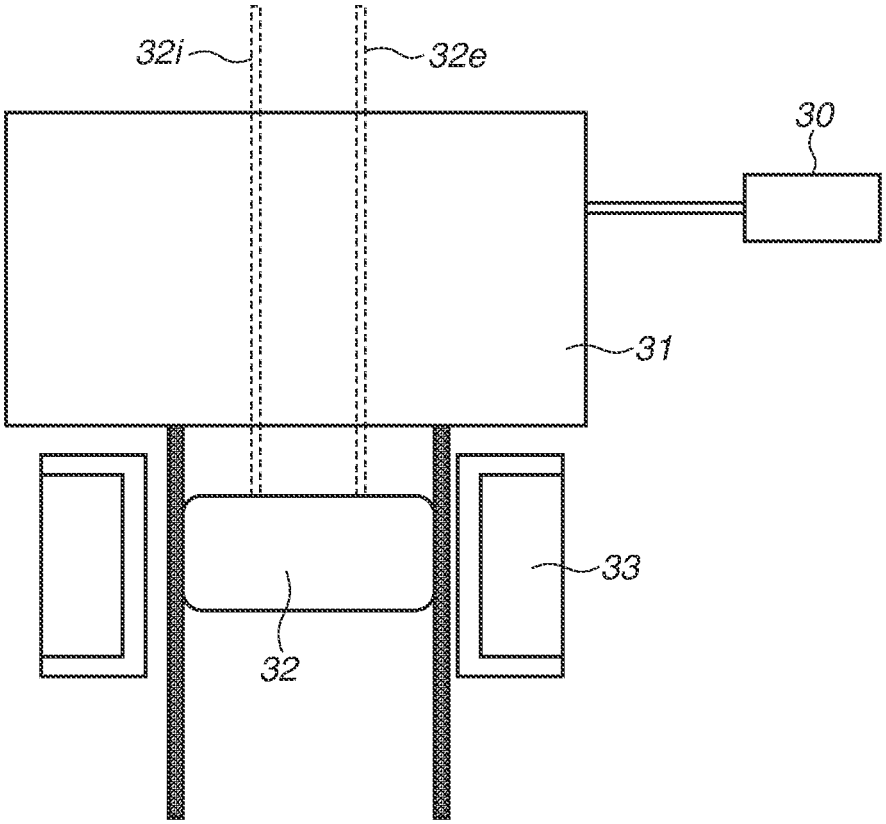
FIG. 3 is a diagram illustrating a molding process according to an exemplary embodiment of the present disclosure.

In continuous melt extrusion of the resin composition from the die, as crystallization is developed, conductive filler agglomeration is promoted. Thus, the key is that the resulting tube-shaped film is in the amorphous state. The circular die, the temperature adjustment form and shape of the circular die, and the resin passing speed at each location have a great impact on resin crystallization and are thus selected carefully. According to the present exemplary embodiment, as illustrated in FIG. 3, a pellet material is fed to a single-screw extrusion with a temperature set to 340° C. to 400° C. and is melted, and a resin belt material PE is melted and extruded downward from a lip (not illustrated) and molded into the shape of a tube through a spiral die 31. At this time, the extraction rate is adjusted to extend the resin belt material PE in a screw direction so that the thickness of the inner surface of the tube in a substantially melt state is brought into contact with a cooling mandrel 32 and is rapidly cooled while the outer surface is slowly cooled using an external heating device 33 to control the crystallinity of the inner and outer surfaces. The resin passing speed is 1.7 mm/s at the lip and 30 mm/s at the cooling mandrel 32. A heater (not illustrated) and a water-cooling device (not illustrated) are embedded into the cooling mandrel 32, and the temperature of a mirror-finished copper surface can be set to any temperature in the range of a cooling water temperature and higher. Temperature-adjusted cooling water is supplied to a water-supply pipe **32*i* and circulated from a water-discharge pipe 32*e* to the water-supply pipe 32*i*** through a constant-temperature bath and a circulation pump.

A melted resin is solidified and changed in phase such that a front layer and a rear layer undergo cooling processes different from each other, and a tube-shaped tubular member having a thickness of 60 μm is prepared.

Heating and Pressing Process

The tubular tube prepared by the molding process is situated to be sandwiched between the hollow cylindrical inner mold and the hollow cylindrical outer mold with controlled inner roughness. Thereafter, the tubular tube is heated to a predetermined temperature between the glass-transition temperature (Tg) and the crystallization start temperature (Ts), pressed to 10 kgf/cm$^2$ or higher under the temperature range, cooled to a temperature lower than or equal to the glass-transition point, and then released from the molds. This increases crystallinity without causing electroconductive filler agglomeration.

Figure 4:
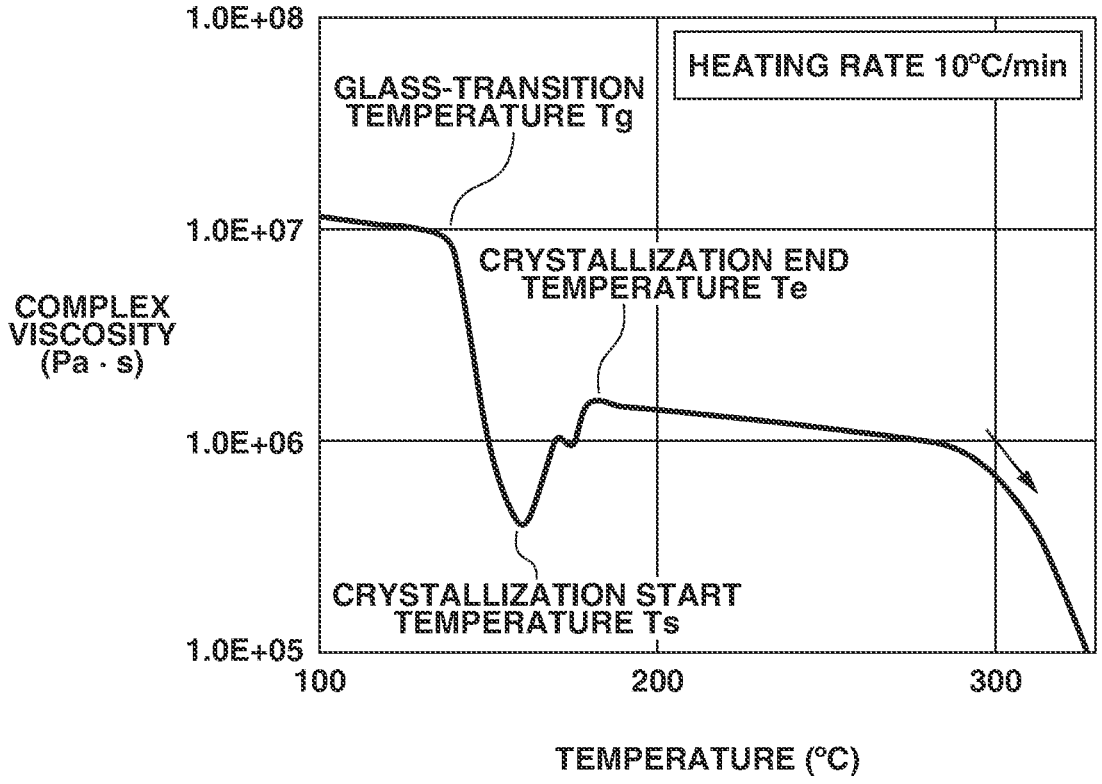
FIG. 4 is a diagram illustrating measured complex viscosities of a polyetheretherketone (PEEK) resin according to an exemplary embodiment of the present disclosure.

The heating temperature is from the glass-transition temperature to a peak vertex temperature which is the crystallization start temperature and at which the viscosity is decreased (FIG. 4), which can be identified by dynamic viscoelasticity measurement (dynamic mechanical analysis (DMA)). In the dynamic viscoelasticity measurement (DMA) of PEEK in FIG. 4, the measurement temperature range is from the glass-transition temperature that is the temperature at which the viscosity starts decreasing in the graph to the crystallization start temperature that is the peak vertex temperature at which the viscosity is decreased in the graph. In a case where the crystallinity is high, a significant decrease in viscosity is not exhibited. Further, the decrease in viscosity from the glass-transition temperature to the crystallization start temperature increases at higher heating rates. The heating is to be conducted to reach a target heating temperature at a temperature increase rate of 10° C./min or higher. In a case where the heating rate is low, the proportion of re-crystallization increases at lower temperatures, and a peak of the decrease in viscosity does not appear, so that it is difficult to transfer the mold surface by heat in the temperature range.

In a case where a thermoplastic resin containing a conductive filler is heated, the viscosity of the thermoplastic resin as a matrix decreases, and the dispersed state of the conductive filler changes. Thus, during the heating and pressing process in a state of being heated to the melting point or higher, slight temperature or pressure unevenness is considered to increase a change in resistance and unevenness. Further, in a case where the heating is conducted to a temperature far beyond the crystallization start temperature, even if the temperature does not reach the melting point, the tubular tube contraction in cooling becomes significant, and the crystallinity becomes excessively high, so that the release from the molds after the cooling is difficult.

On the contrary, in a case where a thermoplastic resin composition containing a conductive filler in an amorphous state is heated and pressed in the range from the glass-transition temperature to the crystallization start temperature, the viscosity increases as the thermoplastic resin is re-crystalized. Thus, an excessive decrease in viscosity is prevented, and the impact on the dispersed state of the conductive filler is low.

2-3. Method of Evaluating Amount of Carbon Black contained in Base Layer

According to the present exemplary embodiment, the amount of carbon black contained in the intermediate transfer member is evaluated by thermal gravimetric analysis (TGA). According to the present exemplary embodiment, a thermal gravimetric measurement device (TGA851e/SDTA) manufactured by Mettler Toledo is used. Heating in a nitrogen gas atmosphere at 600° C. for one hour decomposes and removes the thermoplastic resin in the intermediate transfer belt, and the weight of only the contained carbon is evaluated.

2-4. Method of Evaluation Primary Particle Size of Carbon Black contained in Base Layer Observation of the carbon black contained in the resin composition is conducted using a transmission electron microscope (TEM), and a sectioned sample before observation is prepared using a publicly-known method. For example, a sample can be sectioned using an ion beam or a diamond knife. In the below-described examples, a cut piece of a sample for observation that showed a cross section of the base layer in the entire thickness direction and had a thickness of about 40 nm was collected using "ULTRACUT-S" (product name, manufactured by Leica). Then, a TEM image was acquired using the TEM (product name: H-7100FA, manufactured by Hitachi, Ltd.) in a transverse electric (TE) mode under a measurement condition of an acceleration voltage of 100 kV. The acquired TEM image can be analyzed using publicly-known image analysis software. Examples of known image analysis software are "WinROOF" (product name, manufactured by Mitani Corporation) and "ImagePro" (product name, manufactured by Nippon Roper). According to the present exemplary embodiment, "WinROOF" (product name, manufactured by Mitani Corporation) is used. Then, the diameters of fifty primary particles of the carbon black are measured, and the average of the measured diameters is determined as an average primary particle size.

2-5. Dispersibility Evaluation Method

The dispersed state of the conductive filler in the range (referred to as "outer peripheral surface region") up to 10 μm from the toner image bearing surface in the thickness direction in the measurement target intermediate transfer member (electroconductivity belt) is measured. Further, the dispersed state of the conductive filler in the range (referred to as "inner peripheral surface region") up to 10 μm from the back side of the outer peripheral surface in the thickness direction is measured. Further, the dispersed state of the conductive filler in the range (hereinafter, referred to as "central region") up to 5 μm toward a front surface portion and toward a back surface portion from a central portion of the intermediate transfer member in the thickness direction is measured. The measurement is conducted by the following process.

First, an electroconductive belt is cut in a surface direction into a strip of about 10 mm×10 mm using a cutter knife, and the strip is embedded in an epoxy resin. After curing, a cross-sectional sample is prepared using a polishing sheet. A scanning electron microscopic image (SEM image) magnified 20000 times is acquired for the front surface portion, the back surface portion, and the central portion of each obtained cross-sectional sample using an XL-30 SFEG manufactured by Philips. In a case where the contrast is unsharp, black and white enhancement processing and smoothing processing are performed as needed. Examples of software that can be used as image processing software are Photoshop and ImageJ.

Next, the coordinates of the position of a center of gravity of the conductive filler in a field of view are calculated, and a K-function is calculated using formula 1 below.

$$K(d) = \frac{1}{\lambda}\left(\frac{1}{n}\sum_{i \neq j}\frac{1}{w_{ij}} I_d(i, j)\right) \quad (1)$$

In formula 1, d is a distance in the image, and i and j are indexes each indicating a particle in the image, λ is the number density of particles (the number of particles per unit area) in the image, n is the number of particles in the image, $w_{ij}$ is the ratio between "the area A of a circle i having a radius d from the center of gravity coordinates of the particle i as the center" and "the area B of the portion of the circle i having the radius d from the center of gravity coordinates of the particle i as the center that is included in the image" (area B/area A), wi is to correct an underestimate caused by the absence of a particle outside the image when the particle i is present near a boundary of the image, and $I_d(i, j)$ is a function that gives a value of one in a case where the center of gravity coordinates of the particle j are in the circle having the radius d from the center of gravity coordinates of the particle i as the center or otherwise gives a value of zero (refer to Ripley B. D., J. Appl. Prob, 13, 255 (1976)).

Further, an L-function is calculated based on the calculated K-function using formula 2 below.

$$L(d) = \sqrt{\frac{K(d)}{\pi}} - d. \quad (2)$$

Then, as described below, the simple sum of the values of L(d) calculated for every 10 nm from 0 nm to 500 nm is defined as the L-function value according to the present exemplary embodiment.

$$L(0) = (K(0)/\pi)^{(1/2)}$$

$$L(10) = (K(10)/\pi)^{(1/2)} - 10$$

$$\vdots$$

$$L(490) = (K(490)/\pi)^{(1/2)} - 490$$

$$L(500) = (K(500)/\pi)^{(1/2)} - 500$$

$$L\text{-function value} = L(0) + L(10) + \ldots \ldots + L(490) + L(500)$$

The range of d from 0 nm to 500 nm for use in the L-function calculation indicates the radius of a circle centered at a particle in the image. In a case where the SEM image range for use in evaluation is excessively small with respect to d=500 nm, which is the maximum radius of the measurement circle, an error increases, so that the SEM magnification in the measurement is limited to 20000 times. The size of an observation region in an image captured under the above-described condition depends on a measurement unit and the size of a region that displays "information about something other than an image portion that is included on the image", and the shorter side is substantially 3 μm to 4 μm whereas the longer side is substantially 5 μm to 6 μm. The "information about something other than an image portion that is included on the image" refers to magnification information and scale information, and the portion displaying the information is not included in the measurement target.

Furthermore, the L-function value is calculated for regions (1) to (3) in the below-described examples.

(1) A region centered at a position at a distance of 5 μm from the toner image bearing surface (outer peripheral surface) in the thickness direction.

(2) A region centered at a position at a distance of 5 μm from the back side (inner peripheral surface) in the thickness direction with respect to the outer peripheral surface in (1).

(3) A region centered at the central portion in the thickness direction. The L-function values for the regions (1) to (3) are shown in Table 1.

2-6. Crystallinity Measurement Method

Examples of a method of measuring the crystallinity of a thermoplastic crystalline resin are differential scanning calorimetry measurement (DSC), wide angle X-ray diffraction, small angle X-ray scattering, infrared absorption, and a density method. In the present exemplary embodiment, the crystallinity is calculated by peak demultiplexing using wide angle X-ray diffraction (X-ray diffraction apparatus "Ultima IV" (product name) manufactured by Rigaku Corporation).

A scan angle is 2θ=5° to 45°, and an analysis is conducted using peaks near 2θ=18.8° (=110 plane), 20.95° (=113 plane), 23.1° (=200 plane), and 28.85° (=213 plane) as crystal peaks of the thermoplastic resin PEEK.

2-7. Method of Measuring the Number of Conductive Points

Measurement is conducted using an electric current measurement function of an electron scanning microscope (E-sweep/Nano Navei manufactured by SII Nano Technology Inc.). The back surface of a sample is coated with AuPd, and the sample is fixed to a sample table with a Ag tape. A cantilever is SI-DF3-R, and a measurement region is an 8 μm×8 μm region. The number of pieces of X-direction data is 256, and the number of pieces of Y-direction data is also 256. The scan frequency is 0.5 Hz, and the initial DIF value is 0.55 to 0.65. The amount of deflection of the cantilever is −1. I-, P-, and A-gains are respectively fixed at 0.04, 0.02, and 0. The measurement environment is reduced in pressure to 5E-3 Pa in order to remove adsorbed water at room temperature, and then the measurement is conducted. A point where an electric current of −5 pA or more passes in a case where an application voltage is −40 V is determined as a conductive point.

In a first example, an SB #285 (dibutyl phthalate (DBP) oil absorption=101 ml/100 g, primary particle diameter=26 nm) manufactured by Asahi Carbon Co., Ltd. was used as an electroconductive filler. Further, a PEEK (glass-transition temperature 145° C., crystallization start temperature 165° C., melting point 335° C.) was used as a thermoplastic resin. Further, a tubular tube was prepared using a single-screw extruding/molding machine (Research Laboratory of Plastics Technology Co., Ltd.) with a spiral cylindrical die at a leading end portion. Further, the heating and pressing process was performed on the prepared tubular tube, and an intermediate transfer belt was prepared. The amounts of materials that were blended and the conditions for the molding process and the heating and pressing process were as described below.

Blending Amounts

Carbon black: SB #285 28 parts by weight
Resin material: PEEK (Victrex, 450G) 72 parts by weight Conditions for Molding Process Amount of extrusion: 6 kg/h
Die temperature: 380° C.
External heating device temperature: 300° C.
Cooling mandrel temperature: 140° C.

Conditions for Heating and Pressing Process

Heating temperature: 160° C.

The measurement results of properties of the prepared intermediate transfer member are as shown in Table 1.

First Comparative Example

In the present comparative example, an intermediate transfer member was prepared as in the first example, except that a changed amount of carbon black used as an electroconductive filler and a changed amount of PEEK resin were blended. The electroconductive filler and the resin material that were used in the first comparative example are as described below.

Blending Amounts

Carbon black: SB #285 35 parts by weight
Resin material: PEEK (Victrex, 450G) 65 parts by weight The measurement results of the prepared intermediate transfer member are as shown in Table 1.

Second Comparative Example

In the present comparative example, an intermediate transfer member was prepared as in the first example, except that TOKABLACK #7270SB (DBP oil absorption=37 ml/100 g to 79 ml/100 g, primary particle diameter=36 nm) manufactured by TOKAI CARBON CO., LTD. was used as an electroconductive filler. The electroconductive filler and the resin material that were used in the second comparative example are as described below.

Blending Amounts

Carbon black: #7270SB 28 parts by weight
Resin material: PEEK (Victrex, 450G) 72 parts by weight The measurement results of the prepared intermediate transfer member are as shown in Table 1.

Third Comparative Example

In the present comparative example, an intermediate transfer member was prepared as in the first example, except that the die temperature in the molding process was changed to 450° C.

The measurement results of the prepared intermediate transfer member are as shown in Table 1.

Fourth Comparative Example

In the present comparative example, the preparation was performed as in the first example, except that the temperature of the cooling mandrel in the molding process was changed to 60° C. However, the thickness of the tube-shaped member was significantly uneven, and an intermediate transfer member was not successfully prepared.

Fifth Comparative Example

In the present comparative example, an intermediate transfer member was prepared as in the first example, except that the temperature of the cooling mandrel in the molding process was changed to 170° C.

The measurement results of the prepared intermediate transfer member are as shown in Table 1.

Sixth Comparative Example

In the present comparative example, an intermediate transfer member was prepared as in the first example, except that the temperature of the cooling mandrel in the molding process was changed to 230° C.

The measurement results of the prepared intermediate transfer member are as shown in Table 1.

Seventh Comparative Example

In the present comparative example, an intermediate transfer member was prepared as in the first example, except that the die temperature in the molding process was changed to 400° C. and the temperature of the cooling mandrel was changed to 180° C.

The measurement results of the prepared intermediate transfer member are as shown in Table 1.

Eighth Comparative Example

In the present comparative example, an intermediate transfer member was prepared as in the first example, except that the temperature of the external heating device in the molding process was changed to 250° C.

The measurement results of the prepared intermediate transfer member are as shown in Table 1.

Ninth Comparative Example

In the present comparative example, the preparation was performed as in the first example, except that the temperature of the external heating device in the molding process was changed to 380° C. However, the thickness of the tube-shaped member was significantly uneven, and an intermediate transfer member was not successfully prepared.

Tenth Comparative Example

In the present comparative example, an intermediate transfer member was prepared as in the first example, except that the heating temperature in the heating and pressing process was changed to 100° C.

The measurement results of the prepared intermediate transfer member are as shown in Table 1.

Eleventh Comparative Example

In the present comparative example, the preparation was performed as in the first example, except that the heating temperature in the heating and pressing process was changed to 270° C. However, the tube-shaped member was broken during the cooling in the heating and pressing process, and an intermediate transfer member was not successfully prepared. Under the conditions according to the eleventh comparative example, the crystallinity was 27%, and the mechanical strength of the belt member was insufficient.

During the heating and pressing process, as the heating is continued beyond the crystallization end point or is continued for an excessively long time, crystallization is developed. The development of crystallization may promote carbon black agglomeration to cause a decrease in dispersibility. Thus, it is desirable to set the heating and pressing conditions such that the crystallinity reaches desirably 25% or less, more desirably 20% or less in the heating and pressing process.

Verification of Examples

The belts for electrophotography according to the first example and the first to eleventh comparative examples were attached as an intermediate transfer belt of the electrophotographic image forming apparatus illustrated in FIG. 1. Under a low-humidity environment (23° C./5%), 600000 solid white images were output using the electrophotographic image forming apparatus and A3-size normal sheets (CS068, manufactured by Canon Inc.). Each time 100000 solid white images were output, five black, entirely halftone images were consecutively output. The sixth obtained set, that is to say, five entirely halftone images output after 600000 solid white images were formed, were visually observed and evaluated based on the following criteria.

Image with Missing Parts

A: None of the five halftone images were determined as an image with missing parts.

B: One of the five halftone images was determined as an image with missing parts.

C: Three of the five halftone images were determined as an image with missing parts.

Mechanical Properties

A: A belt breakage did not occur, and a toner image distortion and a color deviation were not confirmed.

B: A belt breakage did not occur, but a toner image distortion or a color deviation was confirmed.

C: A belt breaking occurred.

Image and Mechanical Strength Evaluation Results

The evaluation results of the prepared intermediate transfer belts are shown in Table 2. An image X was with missing parts probably because the particle size of the used carbon black was large or the dispersibility of a conductive agent of the intermediate transfer member decreased due to re-agglomeration during the molding process. In this case, it is considered that the image with missing parts was generated by the electric discharge at a space formed between the inner peripheral surface of the intermediate transfer member and the primary transfer roller at the primary transfer portion or a space formed between the outer peripheral surface of the intermediate transfer member and the sheet at the secondary transfer portion.

Further, the belt breakages and color deviations confirmed during the verification are considered to be due to the low crystallinity of the intermediate transfer belt and a failure to impart desired tensile strength, flexural durability, and surface hardness.

As to the first example, the results regarding an image with missing parts and mechanical strength were both favorable results.

TABLE 1

| | Carbon Black | | Intermediate Transfer Member Measurement Results | | | |
|---|---|---|---|---|---|---|
| | Weight Ratio of Carbon Black (parts by weight) | Primary Particle Size (nm) | Crystallinity (%) | L-function (central region, outer peripheral surface) | L-function (inner peripheral surface) | Number of Conductive Points of Inner Peripheral Surface (points/$\mu m^2$) |
| First Example | 28.0 | 26 | 18 | 81 | 100 | 270 |
| First Comparative Example | 35.0 | 26 | 10 | 64 | 95 | 302 |
| Second Comparative Example | 28.0 | 36 | 18 | 91 | 140 | 243 |
| Third Comparative Example | 28.0 | 26 | 12 | 130 | 120 | 220 |
| Fourth Comparative Example | 28.0 | 26 | — | — | — | — |
| Fifth Comparative Example | 28.0 | 26 | 18 | 89 | 147 | 201 |
| Sixth Comparative Example | 28.0 | 26 | 18 | 150 | 170 | 208 |
| Seventh Comparative Example | 28.0 | 26 | 18 | 96 | 180 | 242 |
| Eighth Comparative Example | 28.0 | 26 | 10 | 92 | 110 | 211 |

TABLE 1-continued

| | Carbon Black | | Intermediate Transfer Member Measurement Results | | | |
|---|---|---|---|---|---|---|
| | Weight Ratio of Carbon Black (parts by weight) | Primary Particle Size (nm) | Crystallinity (%) | L-function (central region, outer peripheral surface) | L-function (inner peripheral surface) | Number of Conductive Points of Inner Peripheral Surface (points/$\mu m^2$) |
| Ninth Comparative Example | 28.0 | 26 | — | — | — | — |
| Tenth Comparative Example | 28.0 | 26 | 4 | 72 | 90 | 275 |
| Eleventh Comparative Example | 28 | 26 | — | — | — | — |

TABLE 2

| | Mechanical Strength | Image with Missing Parts |
|---|---|---|
| First Example | A | A |
| First Comparative Example | C | A |
| Second Comparative Example | A | B |
| Third Comparative Example | A | C |
| Fourth Comparative Example | X | X |
| Fifth Comparative Example | A | C |
| Sixth Comparative Example | A | C |
| Seventh Comparative Example | A | B |
| Eighth Comparative Example | A | B |
| Ninth Comparative Example | X | X |
| Tenth Comparative Example | C | A |
| Eleventh Comparative Example | X | X |

While a belt thickness of 60 μm or more is described as an example according to the present exemplary embodiment, the thickness is not limited to that described above. For example, in a case where the belt thickness is less than 30 μm, the measurement regions of the L-function overlap, but the L-function can be calculated for each region. It is noted that a desirable belt thickness is 30 μm.

The present disclosure realizes an intermediate transfer belt made of a thermoplastic resin containing carbon black with secured mechanical strength of the intermediate transfer belt and improved dispersibility of the carbon black.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-207098, filed Dec. 14, 2020, which is hereby incorporated by reference herein in its entirety.

What is claimed is:

1. An intermediate transfer belt which has an endless belt shape and to which a toner image is to be transferred, the intermediate transfer belt comprising:

a base layer containing a thermoplastic resin with carbon black dispersed in the thermoplastic resin, wherein an average primary particle size of the carbon black is 10 nm or more and 30 nm or less, wherein a content of the carbon black is 15.0% by mass or more and 30.0% by mass or less with respect to the intermediate transfer belt, wherein the thermoplastic resin has a crystallinity of 8% or more and 25% or less, and wherein (Li+Lo+Lc)/3≤100 nm, where Li is a value of an L-function indicating a dispersibility of the carbon black with respect to the thermoplastic resin in an outer peripheral surface region having a range of 10 μm from an outer peripheral surface of the base layer in a thickness direction of the belt member, Lo is a value of the L-function indicating a dispersibility of the carbon black with respect to the thermoplastic resin in an inner peripheral surface region having a range of 10 μm from an inner peripheral surface of the belt member in the thickness direction, and Lc is a value of the L-function indicating a dispersibility of the carbon black with respect to the thermoplastic resin in a central region having a range of 5 μm in the thickness direction and another range of 5 μm in the thickness direction from a central portion of the belt member in the thickness direction.

2. The intermediate transfer belt according to claim 1, wherein the thermoplastic resin is polyetheretherketone.

3. An image forming apparatus comprising:

an image bearing member configured to bear a toner image;

an intermediate transfer belt to which the toner image on the image bearing member is to be primarily transferred;

a metal roller configured to primarily transfer the toner image from the image bearing member to the intermediate transfer belt; and a secondary transfer member configured to secondarily transfer the toner image from the intermediate transfer belt to a recording material, wherein the intermediate transfer belt comprises:

a belt member containing a thermoplastic resin with carbon black dispersed in the thermoplastic resin, wherein an average primary particle size of the carbon black is 10 nm or more and 30 nm or less, wherein a content of the carbon black is 15.0% by mass or more and 30.0% by mass or less with respect to the belt member, wherein the thermoplastic resin has a crystallinity of 8% or more and 25% or less, and wherein (Li+Lo+Lc)/3≤100 nm, where Li is a value of an L-function indicating a dispersibility of the carbon black with respect to the thermoplastic resin in an outer peripheral surface region having a range of 10 μm from an outer peripheral surface of the belt member in a thickness direction of the belt member, Lo is a value of the L-function indicating a dispersibility of the carbon black with respect to the thermoplastic resin in an inner peripheral surface region having a range of 10 μm from an inner peripheral surface of the belt member in the thickness direction, and Lc is a value of the L-function indicating a dispersibility of the carbon black with respect to the thermoplastic resin in a central region having a range of 5 μm in the thickness direction and another range of 5 μm in the thickness direction from a central portion of the belt member in the thickness direction.

4. The image forming apparatus according to claim 3, wherein the thermoplastic resin is polyetheretherketone.

5. The image forming apparatus according to claim 3, wherein Li≤150 nm.

6. The image forming apparatus according to claim 3, wherein the number of conductive points of the inner peripheral surface of the belt member is 230 points/$\mu m^2$ or more.

* * * * *